United States Patent [19]

Kaufman et al.

[11] Patent Number: 4,583,807

[45] Date of Patent: Apr. 22, 1986

[54] SURFACE MOUNT CONNECTOR

[75] Inventors: John W. Kaufman, Hershey; Douglas C. Rubendall, Millersburg, both of Pa.

[73] Assignee: AMP Incorporated, Harrisburg, Pa.

[21] Appl. No.: 763,178

[22] Filed: Aug. 7, 1985

Related U.S. Application Data

[63] Continuation-in-part of Ser. No. 561,099, Dec. 13, 1983.

[51] Int. Cl.[4] ..... H01R 9/09

[52] U.S. Cl. ..... 339/125 R; 339/17 LC

[58] Field of Search ..... 339/17 L, 17 LC, 17 CF, 339/17 C, 125 R, 126 R

[56] References Cited

U.S. PATENT DOCUMENTS

| | | | |
|---|---|---|---|
| 4,196,957 | 4/1980 | Benasutti | 339/17 LC X |
| 4,298,237 | 11/1981 | Griffith et al. | 339/17 L |
| 4,435,031 | 3/1984 | Black et al. | 339/17 C |
| 4,491,376 | 1/1985 | Gladd et al. | 339/17 LC X |
| 4,530,553 | 7/1985 | Aujla | 339/17 LC |
| 4,550,962 | 11/1985 | Czeschila | 339/17 LC |

*Primary Examiner*—Eugene F. Desmond

*Attorney, Agent, or Firm*—Allan B. Osborne

[57] ABSTRACT

The invention disclosed herein is a connector wherein the contact elements include tail sections on one end for being soldered to pads on the circuit board. More particularly the connector carries three rows of contact elements with the tail sections extending out from the housing at different lengths and in a pattern predetermined by the pad spacing and arrangement on the board. The thicknesses of the tail sections reflect the different lengths.

7 Claims, 12 Drawing Figures

SURFACE MOUNT CONNECTOR

This application is a continuation-in-part of application Ser. No. 561,099 filed Dec. 13, 1983.

BACKGROUND OF THE INVENTION

1. Field of the Invention

The invention disclosed herein relates to a male connector of a two connector system wherein the connectors are fixed to respective printed circuit boards and an electrical interconnection is provided between the boards upon mating the two connectors. More particularly, the invention relates to solder mounting the male connector contacts to pads on the circuit board to which it is mounted.

2. Prior Art

Prior art and contemporary connectors of the type disclosed herein are fixed to circuit boards in generally two ways. The leads or pins may be inserted into holes in the circuit board and soldered therein. A second method is to provide a compliancy portion on the pin; e.g., U.S. Pat. No. 4,186,982, and rely thereupon for a frictional retention. However, some users prefer to use circuit boards which do not have pin-receiving holes therethrough, thus necessitating another method of fixing a connector thereto. One such method is disclosed in U.S. Pat. No. 4,439,000 wherein the depending leads are looped around to form a spring arm and the connector housing includes mounting legs having a laterally projecting lip at the free ends. The connector is mounted on the circuit board with the spring arms in electrical contact with circuit pads on one surface of the board and held thereagainst under pressure by the legs extending through mounting holes in the board and being retained by the lips latching against the opposite surface. Whereas this method has great utility in many cases, certain users, particularly the military and aircraft manufacturers, desire a more permanent attachment of the leads to the circuit pads and also where the mounting site can be quickly and easily probed for electrical integrity.

SUMMARY OF THE INVENTION

The invention disclosed herein is to a connector having an insulative housing carrying a plurality of contacts arranged in three longitudinal rows with tail sections extending rearwardly and downwardly from the housing. Each tail section of each row is of a different thickness. The free ends of the tail sections include a concavo-convex-shaped surface which is solder-mounted to conductive pads on the circuit board. Solderable studs depend from the housing and are soldered in respective plated holes in the circuit board to retain the connector thereon and to provide stress relief for the connector.

Figure 1:
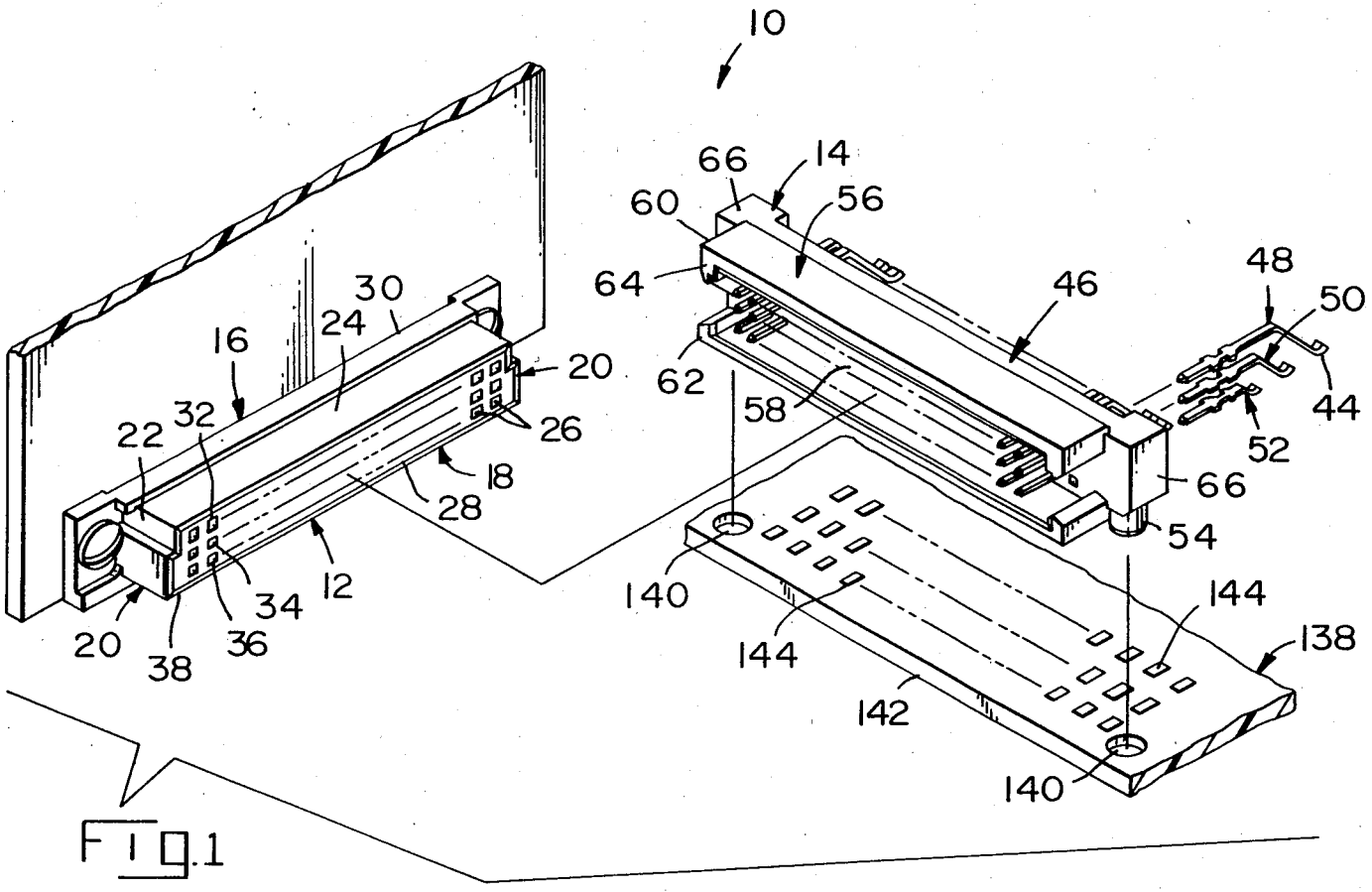
FIG. 1 is a perspective view showing mating receptacle and male connectors for interconnecting one printed circuit board to another printed circuit board or to a backplane.

Connector system 10 shown in FIG. 1 includes receptacle connector 12 and male connector 14.

Receptacle connector 12 includes insulating housing 16 having a forwardly projecting member 18. Sides 20 of member 18 are stepped to provide a relief 22 adjacent top surface 24. A plurality of passages 26 extend through housing 16 from front face 28 to rear face 30. Passages 26 are arranged in three parallel rows 32, 34 and 36 with row 32 being adjacent surface 24, row 36 being adjacent opposite surface 38 and row 34 being between rows 32 and 36.

Figure 2:
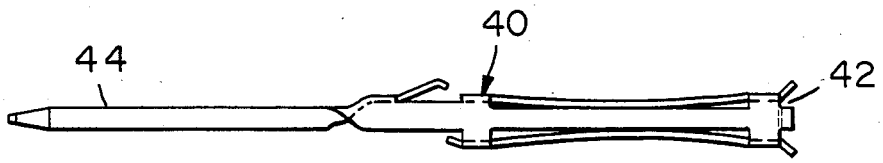
FIG. 2 is a perspective view of a contact housed in the receptacle connector.

A plurality of posted box contacts 40, shown in FIG. 2, are positioned in passages 26 with box receptacle ends 42 opening out to front face 28 and wire wrap posts 44 extending out rear face 30 for insertion into circuit board or backplane 40.

As shown in FIG. 1, male connector 14 includes insulating housing 46, electrical contacts 48, 50, 52 and depending solderable studs 54.

Printed circuit board 138 on which connector 14 is mounted, is shown below.

Insulating housing 46 includes a pin-protecting shroud 56 projecting forwardly from front surface 58. Shroud 56 consists of U-shaped upper and lower members 60, 62 respectively with legs 64 on the former being inwardly thicker to conformably fit into reliefs 22 on projecting member 18 of receptacle connector 12 when connectors 12, 14 are mated together. Reliefs 22 and thick legs 64 cooperate to provide polarizing keys.

Ears 66 form the longitudinal ends of housing 46 and, as will be described below, house depending studs 54.

Figure 3:
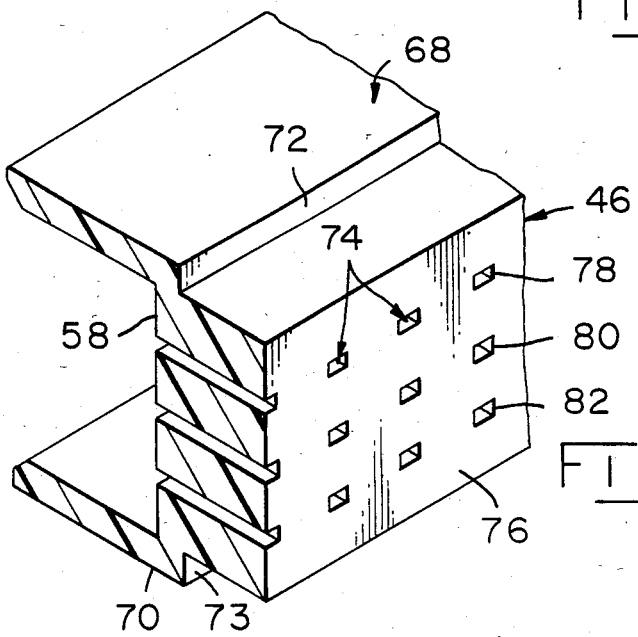
FIG. 3 is a perspective, sectioned view of the male connector housing.

As shown more clearly in FIG. 3, top and bottom surfaces 68, 70 of housing 46 respectively include rearwardly facing upper and lower shoulders 72 and 73 respectively.

A plurality of passages 74 extend through housing 46 from front surface 58 to rear surface 76. As shown in FIG. 3, passages 74 are arranged in three longitudinal and parallel rows 78, 80 and 82. Row 78 is adjacent top surface 68, row 82 is adjacent bottom surface 70 and row 80 is in between. Passages 74 are on the same pattern and spacing as are passages 26 in connector 12.

Figure 4:
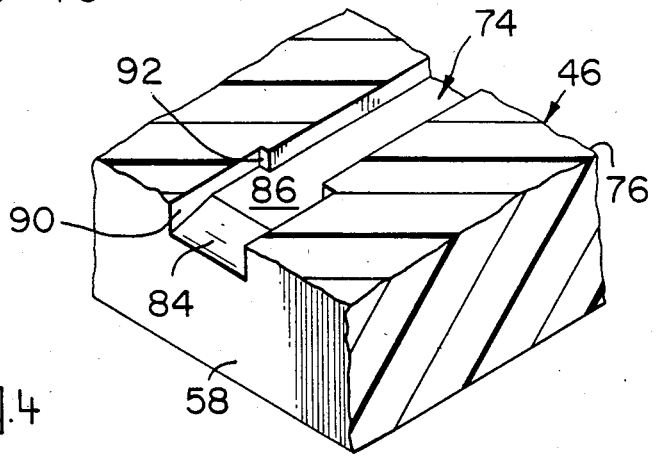
FIG. 4 is a perspective, sectioned view of a passage in the male connector housing.

FIG. 4 shows one half of a passage 74 with each half being a mirror image of the other. Ramp 84, at the passage opening onto front surface 58, leads to passage floor 86 which continues rearwardly to open out onto rear surface 76 of housing 46. Sidewalls 90 are stepped to provide forwardly facing shoulders 92.

Housing 46 is preferably moulded from a polyphenylene sulfide plastic such as sold by the Phillips Petroleum Company under the trademark "RYTON".

Figure 5:
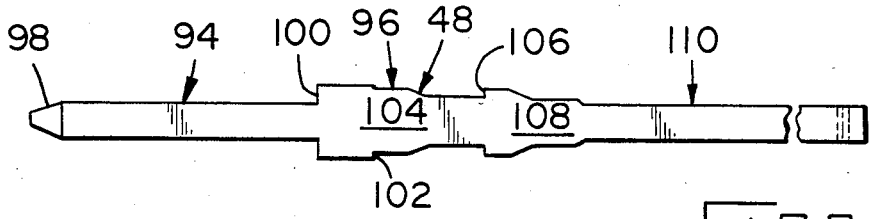
FIGS. 5 and 6 are top and side views of a contact housed in the male connector.

Electrical contacts 48, 50, 52 are identical in shape, differing only in tail section length and thickness as will be described below. A top plan view of a contact 48 is shown in FIG. 5 after being blanked out but prior to being formed. Post section 94 projects forwardly from intermediate section 96 and is received in box receptacle end 42 when connectors 12, 14 are mated together. Beveled tip 98 on post section 94 facilitates entering box receptacle end 42.

Intermediate section 96 includes first forwardly facing shoulders 100, rearwardly facing shoulders 102, narrowing neck portion 104, second forwardly facing shoulders 106 and narrowing connecting portion 108 leading to tail section 110. The width of intermediate section 96 narrows rearwardly; e.g., the width across rearwardly facing shoulders 102 is greater than the width across second forwardly facing shoulders 106.

Figure 6:
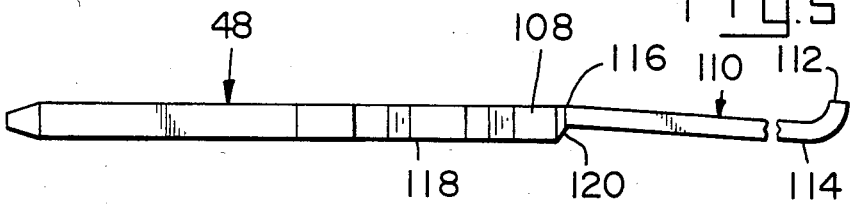

FIG. 6 is a side view of contact 48. Free end 112 of tail section 110 has been formed into a concavo-convex shape and tail section 110 has been slightly bent downwardly at its intersection, with connecting portion 108. This bending permits passing or formed free end 112 through passage 74. The convex surface of free end 112 provides contact area 114 and is the electrical engaging point with conductive pads 144 on circuit board 138. Accordingly area 114 is preferably plated with gold over nickel prior to forming. The thickness of contacts 48, 50, 52 changes at intersection 116 between connecting portion 108 and tail section 110. The decrease in thickness is taken on underside 118 of contacts 48, 50 52 with the change marked by a forty-five degree sloping, rearwardly facing shoulder 120.

As noted above, the difference between contacts 48, 50, 52 is in the length and thickness of tail section 110. The length and thickness for post section 94 and intermediate section 96 on all three contacts 48, 50, 52 are the same; e.g., for a eurocard-type connector having ninety-six contacts (thirty-two per row) the thickness is 0.023 inches and post section 94 is 0.347 inches (8.81 mm) long and intermediate section 96 is 0.023 inches (0.58 mm) long. The length and thickness of tail section 110 on the three contacts 48–52 are:

| Contact | Length | Thickness |
|---|---|---|
| 48 | 0.785 inches (19.9 mm) | 0.014 inches (0.36 mm) |
| 50 | 0.632 inches (16.1 mm) | 0.010 inches (0.25 mm) |
| 52 | 0.481 inches (12.2 mm) | 0.006 inches (0.15 mm) |

Contacts 48, 50, 52 are preferably stamped and formed from phosphor bronze on continuous strip. The carrier strip (not shown) would be attached to intermediate section 96 between shoulders 100 and 102.

Figure 7:
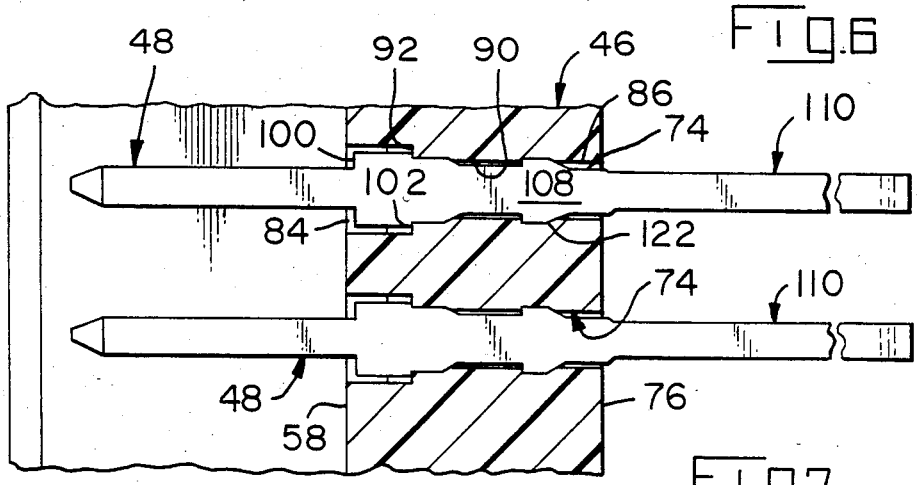
FIG. 7 is a sectioned view of two contacts positioned in the passage shown in FIG. 4.

FIG. 7 is a sectioned, top plan view showing two contacts 48 in passages 74 in housing 46. Contacts 48, formed as shown in FIG. 6, are inserted, tail section 110 first, into passages 74 from their opening at front surface 58. First forwardly facing shoulders 100 provide a seat for an insertion tool (not shown). Ramps 84 guide contact 48 onto passage floor 86.

Beveled sides 122 of connecting portion 108 on contact 48 gash sidewalls 90 behind forwardly facing shoulders 92, providing an interference fit of contact 48 within passage 74. Insertion depth is controlled by rearwardly facing shoulders 102 on contact 48 abutting forwardly facing shoulders 92 on sidewalls 90. Tail section 110 exits from passage 74 at rear surface 76. Contacts 50 and 52 are inserted in an identical manner.

Figure 9:
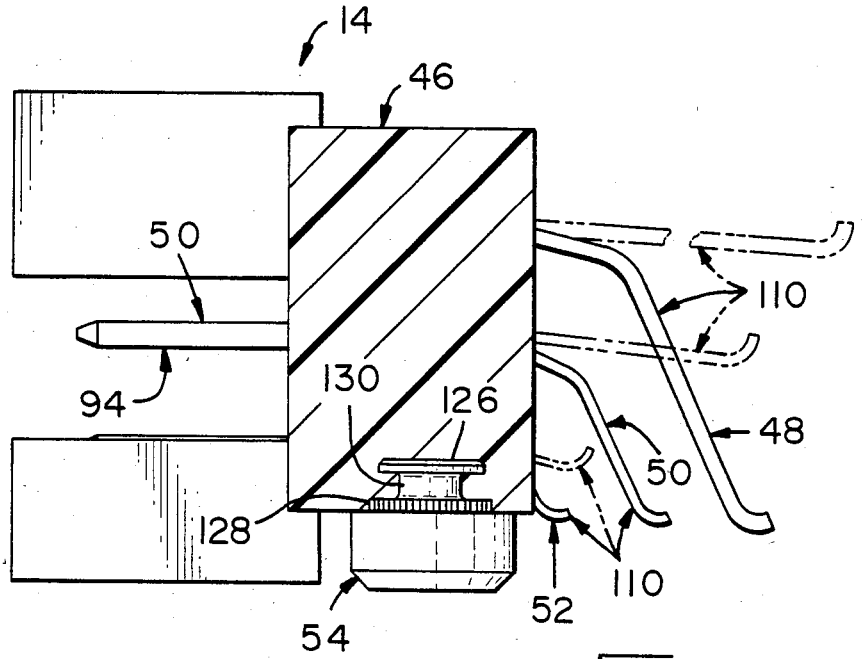
FIG. 9 is a sectioned view of the male connector showing the stud of FIG. 8 secured therein.

Subsequent to being positioned in passages 74, tail sections 110 on contacts 48, 50, 52 are bent downwardly using mandrels (not shown) therefor. For contacts 48, tail sections 110 are bent 126 degrees relative to intermediate sections 96 thereon, tail sections 110 on contacts 50 are bent 136 degrees relative to intermediate sections 96 thereon and tail sections 110 on contacts 52 are bent 110 degrees relative to intermediate sections 96 thereon. The point of tail section 110 bending on contacts 48 is twenty-eight percent of the tail section total length back from intersection point 116, on contacts 50 it is thirty-two percent and on contacts 52 it is twenty-seven percent. FIG. 9 shows tail sections 110 prior to forming in dashed lines and post-forming in solid lines.

Figure 8:
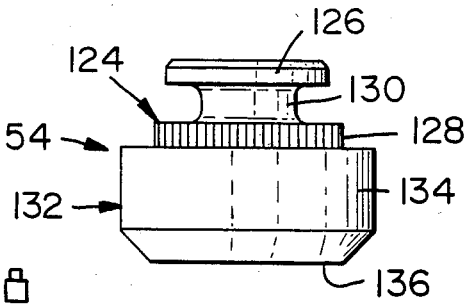
FIG. 8 is a view illustrating a mounting stud for the male connector.

Cylindrical stud 54, shown in enlarged scale in FIG. 8, is preferably made from a brass rod (not shown), half hardened and plated with tin/lead over nickel. Top section 124 includes overhanging plate 126, knurled portion 128 and a slender neck 130 therebetween. Lower section 132 includes body 134 and tapered tip 136.

Studs 54, with top sections 124 positioned in downwardly open holes (not shown) in each ear 66, are bonded therein by conventional ultrasonic heat staking. As shown in FIG. 9 the plastic has flowed in around neck 130, under plate 126 to secure stud 54 in ear 66. Further, the plastic has flowed in the grooves of knurled portion 128 to prevent stud 54 from turning.

Figure 10:
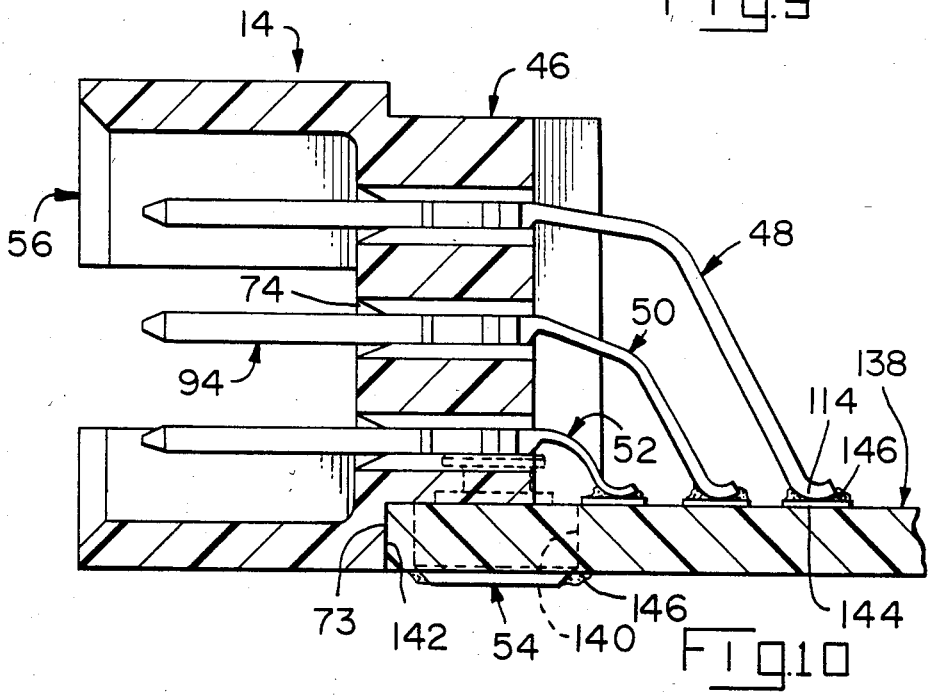
FIG. 10 is a sectioned view of the male connector mounted on a printed circuit board.

With reference to FIG. 1, connector 14 is mounted on circuit board 138 with studs 54 entering plated holes 140 and with lower shoulder 73 on housing 46 abutting circuit board edge 142. Contact areas 114 are automatically registered with the proper conductive pads 144 on board 138; i.e., contact area 114 on contacts 48 are placed on respective pads 144 forming the third row in from edge 142, contact area 114 on contacts 50 are placed on respective pads 144 forming the second row in from edge 142 and contact area 114 on contacts 52 are placed on respective pads 144 forming the first row in from edge 142. Thereafter temporary clamps (not shown) secure connector 14 and board 138 together for reflow or vapor phase soldering of contact areas 114 to respective pads 144 and studs 54 in plated holes 140. The clamps are removed and board 138 with connector 14 now soldered thereto is washed to complete the mounting operation. FIG. 10 is a side sectional view showing connector 14 soldered to board 138. Solder filets are indicated by reference numeral 146.

Figure 11:
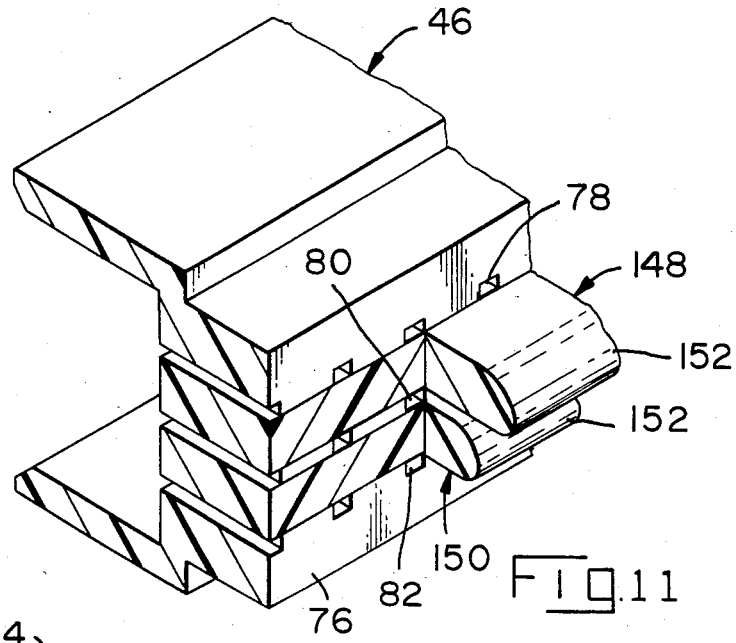
FIGS. 11 and 12 illustrate another embodiment of the male connector.
Figure 12:
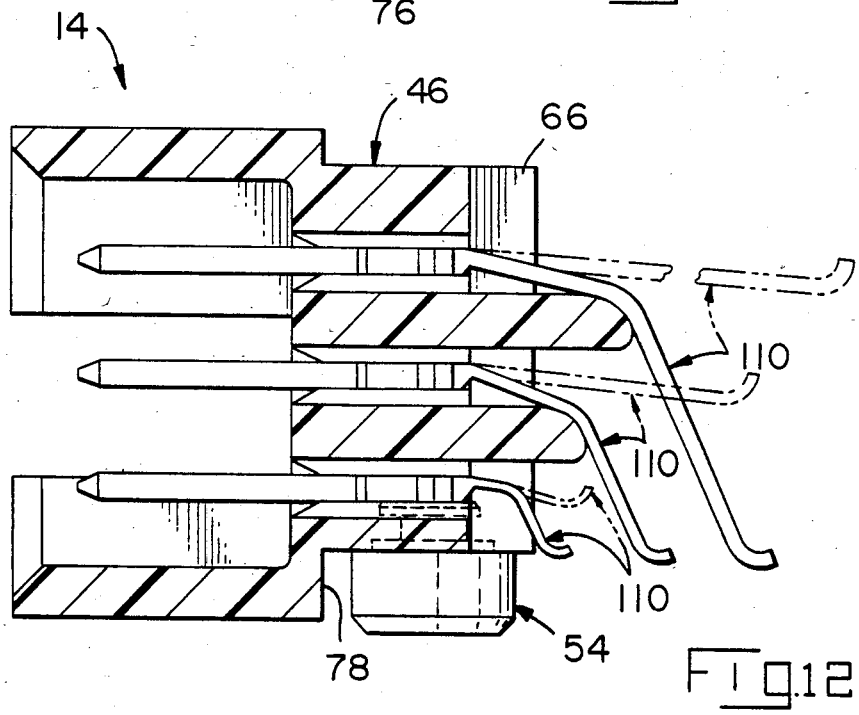

FIGS. 11 and 12 are views of another embodiment of housing 46. A pair of spaced apart ribs 148 and 150, extending longitudinally between opposing ears 66 project rearwardly from rear surface 76. Rib 148 is located between passage rows 78, 80 and projects further rearwardly than rib 150 which is located between passage rows 80, 82. Both ribs include a curved free end 152.

Ribs 148 and 150 provide a forming mandrel for bending tail sections 110 on contacts 48 and 50 downwardly. As shown in FIG. 12, the dashed lines indicate the positioning of tail sections 110 on contacts 48, 50 and 52 respectively after insertion in passages 76.

Bending tail sections 110 on contacts 48 and 50 down around curved free ends 152 on ribs 148, 150 respectively positions contacts areas 114 in proper alignment to meet respective conductive pads 144 upon mounting connector 14 to circuit board 138. As shown in FIG. 12, tail section 110 on contacts 52 must be bent around a removable mandrel (not shown).

As is well known, circuit boards and connectors and components mounted thereon are subjected to forces; e.g., thermal, which places substantial stress on soldered surface mounted devices such as contact areas 114 on contacts 48, 50, 52. Soldered in studs 54 anchors connector 14 more firmly to board 138 so that the two move together, thus reducing the stresses on soldered contact areas 114.

Experience has shown that circuit board warpage can occur while convex surfaces 114 are being soldered to pads 144 where the thickness of tail sections 110 on all three contacts 48, 50, 52 are the same. It was determined that what was happening was that with connector 14 clamped to board 138, the three different length but equal thickness tail sections 110 were creating three forces of different magnitudes against board 138 and warping it. The problem was solved by reducing the thicknesses of tail sections 110 on contacts 50, 52 as set out above so as to equalize the forces.

We claim:

1. An electrical connector for mounting on a printed circuit board, comprising:

a dielectric housing having first, second and third parallel rows of passages extending from a front surface to a rear surface thereof, said first row of passages being adjacent a top surface of said housing, said second row of passages being immediately below said first row and said third row of passages being adjacent a bottom surface of said housing;

a plurality of electrical contacts disposed in respective passages of said first, second and third rows, said contacts including post sections intermediate sections and tail sections, said post sections extending forwardly from said front surface of the housing, said intermediate sections retained in said passages and said tail sections extending rearwardly and downwardly from said rear surface of said housing and being disposed in first, second and third rows with the first row furthest from said housing, the third row closest to said housing and the second row in between said first and third rows, said tail sections having convex shaped free ends for soldered connection with respective conductive pads on a printed circuit board; and securing means provided by said housing for securing the electrical connection onto the printed circuit board so as to position said convex shaped free ends on said respective conductive pads, wherein the thicknesses of the tail sections vary according to the rows with those disposed in the first row being thickest, those disposed in the third row being thinnest and those disposed in the second row being of an intermediate thickness.

2. An electrical connector according to claim 1 wherein said dielectric housing includes a shroud extending forwardly from said front surface and covering said post sections.

3. An electrical connector according to claim 1 wherein said securing means include depending soldered studs for positioning in and being soldered to plated holes in the printed circuit board.

4. An electrical connector according to claim 3 wherein said studs include a top section for being heat staked in said dielectric housing and having a knurled portion extending longitudinally on said top portion to prevent said stud from turning.

5. An electrical connector according to claim 1 wherein said intermediate sections on said electrical contacts include laterally projecting beveled sides for digging into the passage walls to provide an interference fit therein.

6. An electrical connector according to claim 5 wherein said intermediate sections include rearwardly facing shoulders and said passages include forwardly facing shoulders to engage said rearwardly facing shoulders to prevent rearward withdrawal of said contacts from said passages.

7. An electrical connector according to claim 1 further including longitudinally extending ribs projecting rearwardly from the rear surface of said dielectric housing and located between said rows of passages, said ribs having a curved free end around which said tail sections on the electrical contacts may be bent.

* * * * *